US005487509A

United States Patent [19]

Hama

[11] Patent Number: 5,487,509

[45] Date of Patent: Jan. 30, 1996

[54] CRUSHER AND A CRUSHING MECHANISM FOR THE SAME

[75] Inventor: Tomio Hama, Ina, Japan

[73] Assignee: Kabushiki Kaisha Harmo Souken, Nagano, Japan

[21] Appl. No.: 247,847

[22] Filed: May 23, 1994

[30] Foreign Application Priority Data

May 27, 1993 [JP] Japan ..... 5-126033
May 27, 1993 [JP] Japan ..... 5-126034

[51] Int. Cl.[6] ..... B02C 9/04; B02C 1/00

[52] U.S. Cl. ..... 241/152.2; 241/263

[58] Field of Search ..... 241/262, 263, 241/270, 283, 152.1, 152.2

[56] References Cited

U.S. PATENT DOCUMENTS

| | | | |
|---|---|---|---|
| 31,027 | 1/1861 | Middleton | 241/262 |
| 2,208,165 | 7/1940 | Sheahan | 241/262 X |
| 4,327,543 | 5/1992 | Currie et al. | 241/262 X |
| 4,848,679 | 7/1989 | Blumer | 241/262 X |

FOREIGN PATENT DOCUMENTS

| | | | |
|---|---|---|---|
| 725353 | 5/1932 | France | 241/262 |
| 613461 | 2/1966 | Japan . | |
| 64154072 | 1/1991 | Japan | 241/262 |
| 82212 | 1/1951 | Norway | 241/262 |

*Primary Examiner*—Timothy V. Eley

[57] ABSTRACT

The object of the present invention is to provide a crusher, which is capable of efficiently crushing materials or scraps, and a crushing mechanism for the crusher. To achieve the object, the crusher of the present invention comprises: a fixed member having a first blade portion for crushing a material to be crushed into pieces; a movable member being capable of moving to and away from the fixed member, the movable member having a second blade portion, which crushes the material into pieces with the first blade portion when the movable member is moved toward the fixed member; and a driving mechanism for moving the movable member to and away from the fixed member.

11 Claims, 11 Drawing Sheets

CRUSHER AND A CRUSHING MECHANISM FOR THE SAME

BACKGROUND OF THE INVENTION

The present invention relates to a crusher and a crushing mechanism for the same, more precisely relates to a crusher, which is capable of crushing scraps, e.g., resin runners formed during plastic molding processes, rubber materials, metals, so as to reuse them.

Various types of crushers have been known, e.g., Japanese Utility Model Publication Gazette No. 61-3461. One of conventional crushers, which crushes plastic scraps, e.g., resin runners, into pieces for a reuse, is shown in FIGS. 16 and 17. FIG. 16 is a side sectional view of the conventional plastic crusher; FIG. 17 is a plan view thereof. In the conventional plastic crusher, there are provided a plurality of blade members 5 on a shaft 4 at regular intervals. A fixed member 7 has a plurality of blades 8, which are arranged like comb-teeth. Each blade member 5 has a plurality of blades 6, which are arranged in the circumferential direction of the blade member 5 at regular intervals. The blades 6 of each blade member 5 are capable of passing through a gap 8 between the blades with the rotation of the shaft 4, so that materials or plastic scraps can be crushed by them.

Though there are various types of crushers, all of them have the rotary blade members 5 for crushing materials or scraps as an essential element.

However, the conventional crushers having the rotary blade members have following disadvantages.

① It is difficult to make pieces crushed in a uniform size. Some materials can be passed through gaps between the blades 6 and 8 without being crushed, so that they are discharged with large sizes.

② The blade members 5 must hold materials to crush them. But the materials will be free from the blade members 5 when the blade members 5 insufficiently hold them, so that the crushing efficiency cannot be raised.

③ If crushing is continued without discharging pieces crushed, the crusher is overheated by frictional heat among the materials.

④ Some materials are not crushed by the blades 6, and they stay between the blades 8.

⑤ If crushing is continued without discharging the pieces crushed, minute resin particles are scattered so that work environment will be worse.

SUMMARY OF THE INVENTION

An object of the present invention is to provide a crusher, which is capable of efficiently crushing materials or scraps, and a crushing mechanism for the crusher.

To achieve the object, the crusher of the present invention comprises:

a fixed member having a first blade portion for crushing a material to be crushed into pieces;

a movable member being capable of moving to and away from the fixed member, the movable member having a second blade portion, which crushes the material into pieces with the first blade portion when the movable member is moved toward the fixed member; and a driving mechanism for moving the movable member to and away from the fixed member.

In the crusher, for example, the first blade portion may include: a first shearing section for primarily shearing the material; and a second shearing section for secondarily shearing the material, which has been primarily sheared. And the second blade portion may include: a third shearing section, which primarily shears the material with the first shearing section when the movable member is moved toward the fixed member; and a fourth shearing section, which secondarily shears the material, which has been primarily shears by the first shearing section and the third shearing section, with the second shearing section when the movable member is further moved toward the fixed member. In this case, a fixed member proper and a movable member proper may be formed into block shapes; the first shearing section may have a plurality of groove-blades, which are formed with parts of an edge of the fixed member proper and side sections of a plurality of projected sections, which are projected from the edge thereof like comb-teeth; the second shearing section may have a plurality of concave sections, which are formed in fixed end portions of the projected sections; the third shearing section may have a plurality of projected blades, which are arranged in the movable member proper so as to engage with the groove-blades of the first shearing section; and the fourth shearing section may have a plurality of projections, which are arranged in the movable member proper so as to fit into the concave sections of the second shearing section.

On the other hand, the crushing mechanism of the present invention comprises:

a first member being formed into a block;

a second member being formed into a block, the second member being capable of moving to and away from the first member;

a first shearing section having a plurality of groove-blades, which are formed with parts of an edge of the first member and side sections of a plurality of projected sections, which are projected from the edge thereof like comb-teeth;

a second shearing section having a plurality of concave sections, which are formed in fixed end portions of the projected sections;

a third shearing section having a plurality of projected blades, which are arranged in the second member so as to engage with the groove-blades of the first shearing section; and a fourth shearing section having a plurality of projections, which are arranged in the second member so as to fit into the concave sections of the second shearing section.

In the crusher of the present invention, materials are crushed by the fixed blade portion and the movable blade portion with the reciprocative movement of the movable member, so that they are sufficiently held and crushed. Especially, materials are pinched and held by the fixed blade portion and the movable blade, so that crushing power directly and effectively works to the materials. Thus, the energy consumption can be reduced and the crushing efficiency can be raised. With higher crushing efficiency, a small and light crusher having high performance can be provided.

BRIEF DESCRIPTION OF THE DRAWINGS

Embodiments of the present invention will now be described by way of examples and with reference to the accompanying drawings, in which.

DETAILED DESCRIPTION OF PREFERRED EMBODIMENTS

Preferred embodiments of the present invention will now be described in detail with reference to the accompanying drawings.

Figure 1:
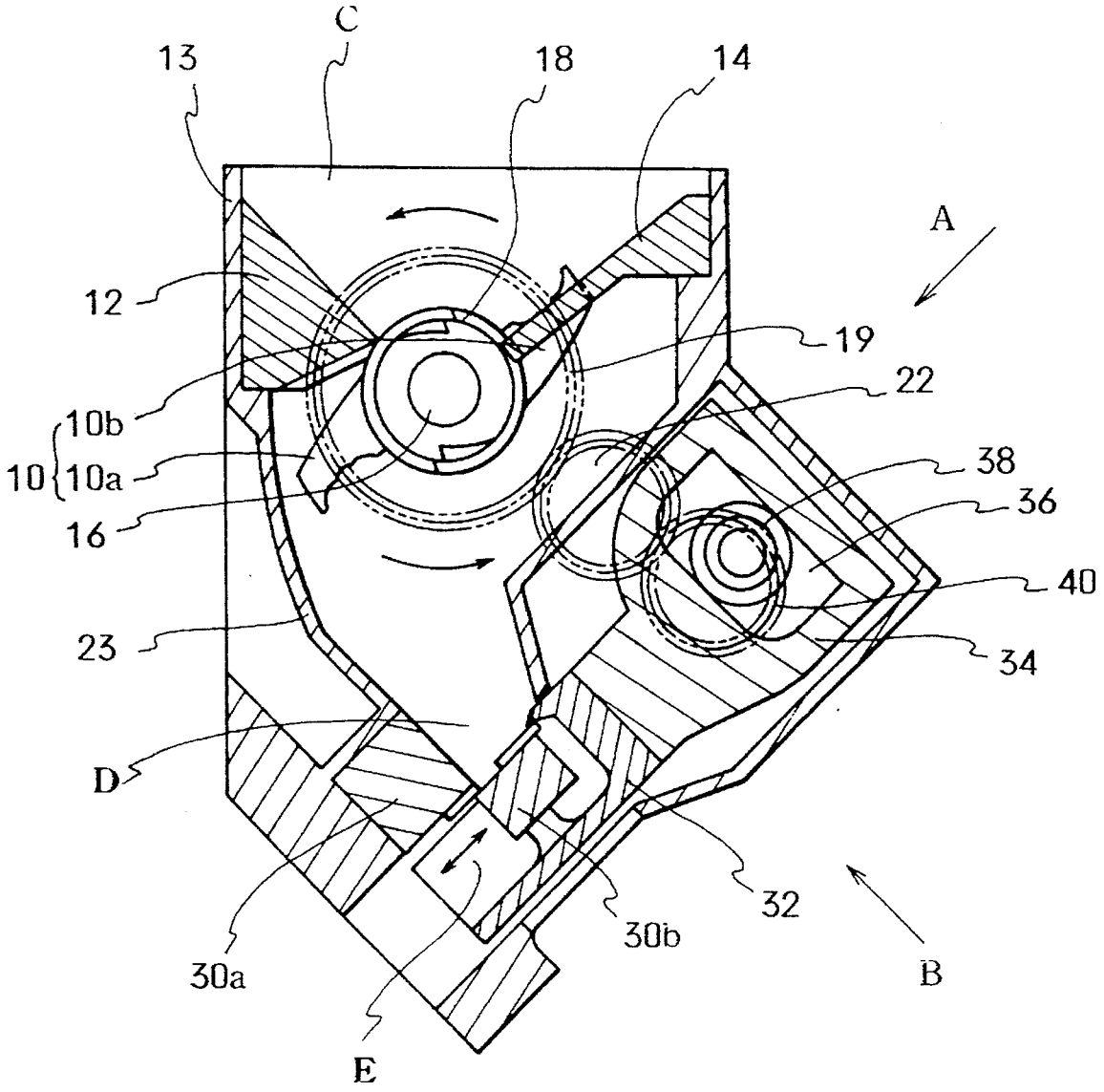
FIG. 1 is a side sectional view of a crusher of an embodiment of the present invention.
Figure 2:
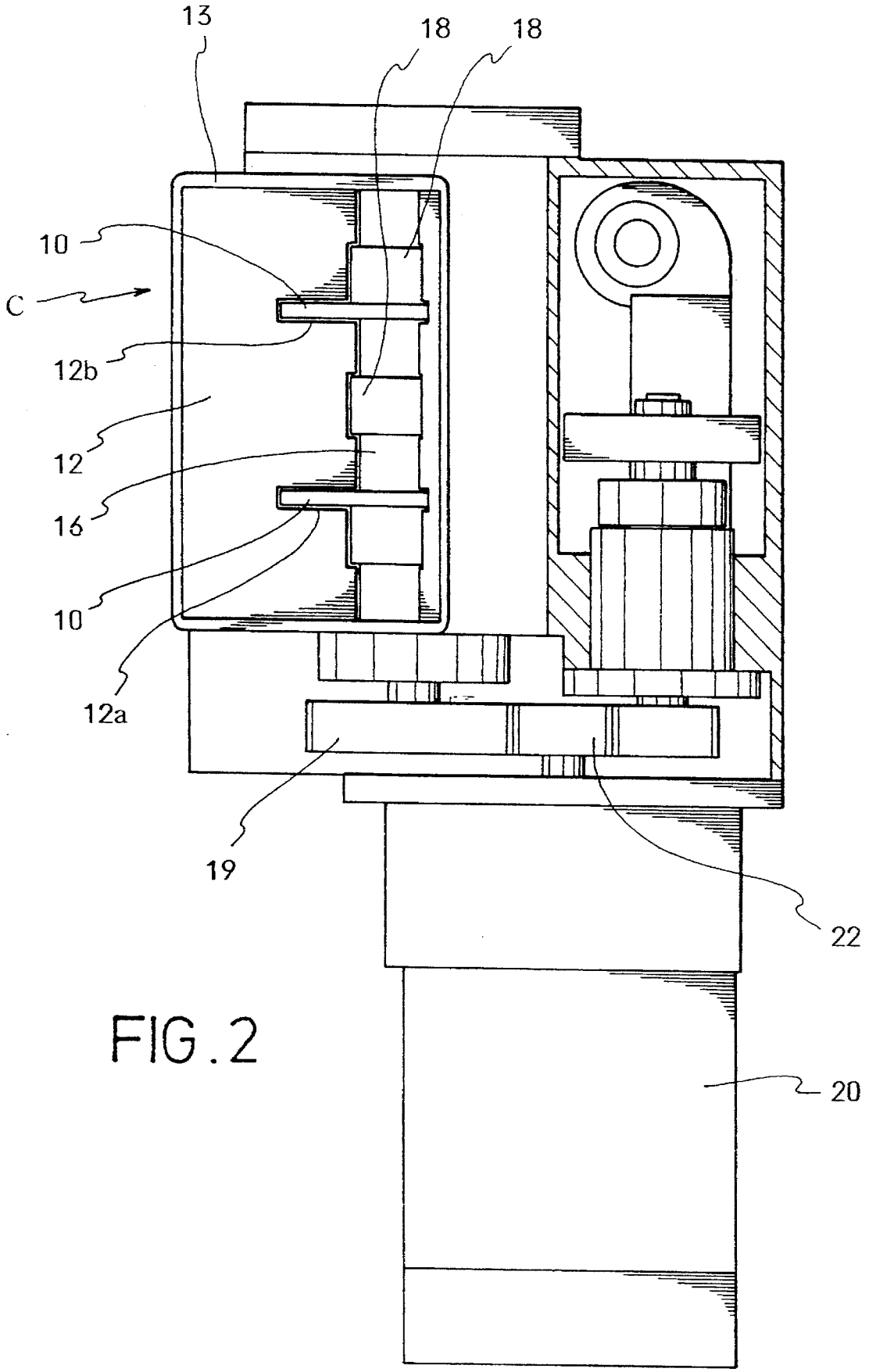
FIG. 2 is a view in the direction of an arrow A shown in FIG. 1.
Figure 3:
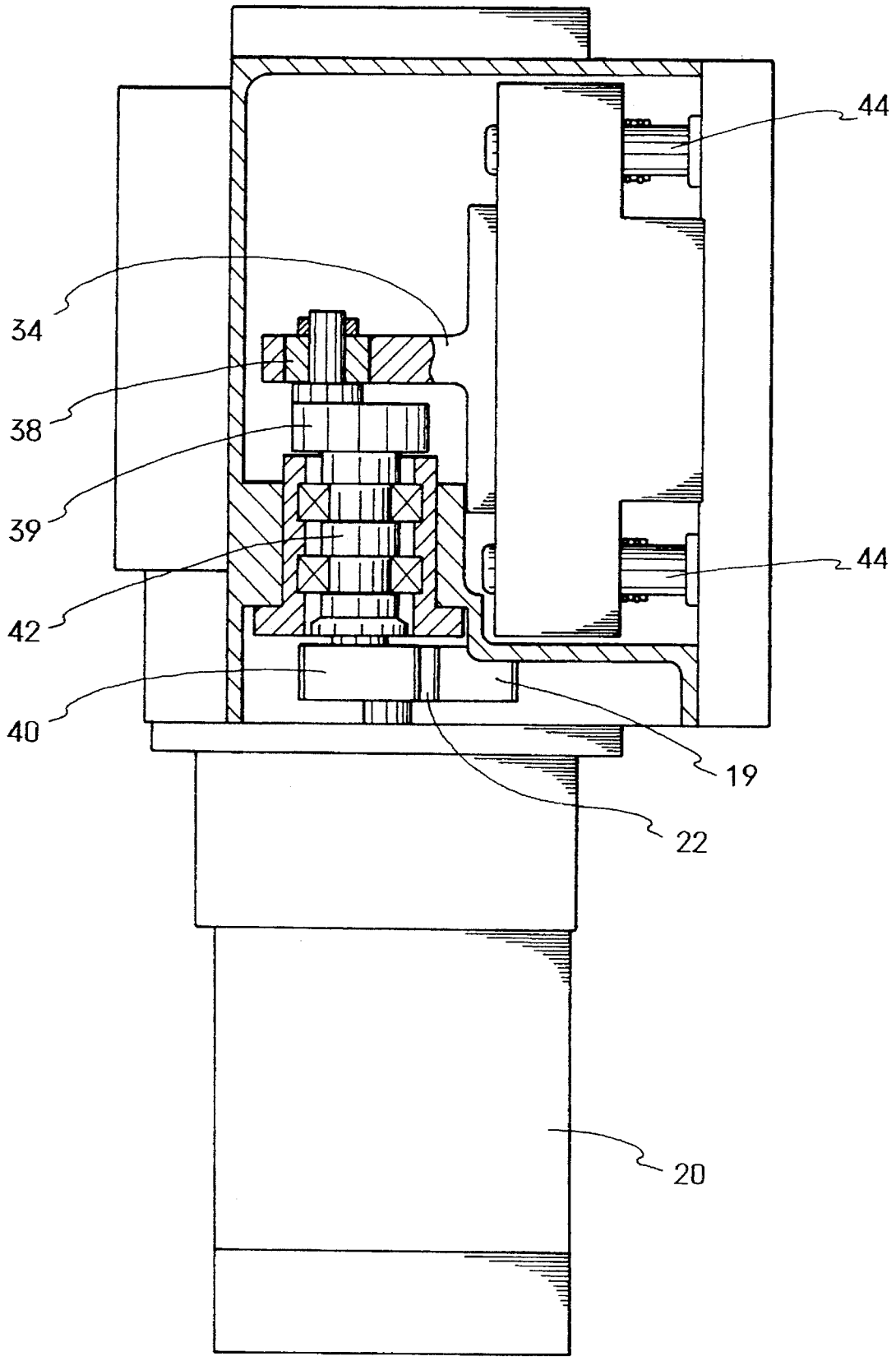
FIG. 3 is a view in the direction of an arrow B shown in FIG. 1.

FIG. 1 is a side sectional view of a crusher of the embodiment, FIG. 2 is a view in the direction of an arrow A shown in FIG. 1, and FIG. 3 is a view in the direction of an arrow B shown therein.

In the crusher of the present invention, the process of crushing materials to be crushed, e.g., plastic scraps, is characterized in that the materials are preparatorily crushed into medium size pieces by a preparatory crushing section having rotary blade members, then they are crushed into small pieces by a crushing section.

In FIG. 1, the preparatory crushing section C has the rotary blade members 10 for preparatorily crushing plastic scraps into medium size pieces. The crushing section D crushes the medium size pieces into small pieces, e.g., pellets.

The rotary blade members 10 are provided in a casing 13, whose upper face is opened. Receiving sections 12 and 14 are provided on both sides of the rotary blade members 10. The receiving sections 12 and 14 are capable of receiving the scraps, which have been put into the casing 13, and collecting them onto the rotary blade members 10. Therefore, inner edges of the receiving sections 12 and 14 are lowered.

The rotary blade members 10 are fixed on a horizontal drive shaft 16 with a proper clearance (see FIG. 2). Fact rotary blade member 10 has two blades 10*a* and 10*b*, which are symmetrically provided with respect to the drive shaft 16 (see FIG. 1). The receiving section 12 has fixed blades 12*a* and 12*b*, which cooperate with the blades 10*a* and 10*b* to crush scraps.

The blades 10*a* and 10*b* are extended relatively long with respect to the drive shaft 16 so as to efficiently catch scraps. Furthermore, there are fixed three small rotary blade members 18 on the drive shaft 16, and they are provided between the rotary blade members 10 and on outer side of each rotary blade member 10. The small rotary blade members 18 are capable of transferring and collecting scraps onto the receiving section 12, so that the scraps can be crushed by the blades 10*a* and 10*b* of the rotary blade members 10. As described above, the scraps are preparatorily crushed into medium size pieces by the rotary blade members 10 and the small rotary blade members 18 in the preparatory crushing section C, and fall into the crushing section D.

As clearly shown in FIG. 2, a gear 19 is fixed at an end of the drive shaft 16. A gear 22, which is fixed to an output shaft of a motor 20, is engaged with the gear 19. The gear ratio between the gears 22 and 19 is 1:2, so that the drive shaft 16 is made a half turn for each full turn of the gear 22.

The crushing process of the preparatory crushing section C with the rotary blade members 10 is basically the same as that of the conventional crusher. On the other hand, the crushing process of the crushing section D is very unique. As shown in FIG. 1, the scraps, which have been crushed into medium size pieces in the preparatory crushing section C, fall in the crushing section D. A duct 23 connecting the sections C and D is formed like a hopper. There are provided a fixed member 30*a* and a movable member 30*b* at a lower end of the duct 23. The fixed member 30*a* has a first blade portion the movable member 30*b* has a second blade portion, which is capable of slidably engaging with the first blade portion of the fixed member 30*a*. By the first and the second blade portions, the medium-sized scraps (pieces) can be crushed smaller.

The movable member 30*b* is linearly and reciprocatively moved in the direction of an arrow E (see FIG. 1) along a bottom face of the fixed member 30*a* for crushing scraps. Note that, the fixed member 30*a* and the movable member 30*b* are inclined with respect to the vertical line so as to introduce the scraps to an engaging portion of the fixed member 30*a* and the movable member 30*b*. With this structure, the movable member 30*b* is diagonally moved in the direction E for crushing.

In the present embodiment, a driving mechanism for reciprocatively moving the movable member 30*b* has a cam mechanism. Namely, the movable member 30*b* is fixed to a movable board 32; the movable board 32 is fixed to a cam board 34 having a window 36; a roller 38 is rotatably fitted in the window 36; the roller 38 is eccentrically fixed to a rotary plate 39; and the rotary plate 39 is connected to a gear 40, which is engaged with the gear 22. Note that, the gear ratio between the gears 22 and 40 is 1:1.

The cam mechanism including the cam board 34, the rotary plate 39, etc. is shown in FIG. 3. The rotary plate 39 is connected to a gear shaft 42 of the gear 40. The gear shaft 42 is rotatably held by bearings. The reciprocative movement of the cam board 34 is guided by guide shafts 44.

When the gear 22 is rotated by the motor 20, the rotary plate 39 rotates and the roller 38 moves with a circular track. By the circular movement of the roller 38, the cam board 34 and the movable board 32 are reciprocatively moved along the guide shafts 44. Thus, the movable member 30*b* is reciprocatively moved, and the scraps are crushed by the fixed member 30*a* and the movable member 30*b*.

In the present embodiment, by said gear ratio, the rotary blade members 10 are made a half turn for preparatory crushing with respect to each reciprocative movement of the movable member 30*b*. Note that, the reciprocative movement of the movable member 30*b* is designed to start after the rotary blade members 10 complete the preparatory crushing. By shifting the timing of the movable member 30*b* with respect to that of the rotary blade members 10, load of the driving mechanism can be reduced.

Though many of plastic scraps such as runners have complex shapes, the crushing section D of the present embodiment is designed to crush scraps having simple shapes, e.g., rod shape. Thus, the preparatory crushing section C crushes scraps into simple shapes with medium sizes before crushing by the crushing section D.

Another embodiment will be explained with reference to FIGS. 4 and 5. In this embodiment, each rotary blade member 10 has blades 10*c* and 10*d*, which are different from the blades 10*a* and 10*b* (see FIG. 1) in shape, and the drive mechanism has a cam 45 instead of the roller 38. The circumferential width of base portions of the blades 10*c* and 10*d* is wider than that of the blades 10*a* and 10*b*. If the circumferential width of the base portions of the blades 10*c* and 10*d* is narrow, scraps are allowed to pass downward through gaps between the blades 12*a* after the blades 10*c* and 10*d* pass through said gaps. By making the blades 10*c* and 10*d* wide, it takes the blades 10*c* and 10*d* a long time to pass through the gaps, so that scraps can be held on the blades 12*a* and they are prevented from falling down without being preparatorily crushed.

Moreover, since front end portions of the blades 10*c* and 10*d* are made sharp, scraps can be caught and introduced to inner portions of the blades 10*c* and 10*d*, so that effective crushing can be executed.

In the driving mechanism for reciprocatively moving the movable member 30*b*, the gear 40 is engaged with the gear 22, which is driven by the motor 20 (see FIGS. 1 and 3); the gear 40 is fixed to the gear shaft 42; the cam 45 is fixed to the gear shaft 42; and a roller 46 always contacts an outer circumferential face of the cam 45. With this structure, the roller 46 is pushed and moved by the rotation of the cam 45. As clearly shown in FIG. 4, the roller 46 is rotatably held on the movable board 32, which holds the movable member 30*b*. The driving mechanism of the present invention the movable board 32 is linearly moved along the guide shafts 44 as well as the driving mechanism shown in FIGS. 1–3. The movable board 32 is always biased upward by springs 47, so that the roller 46 can contact the outer circumferential face of the cam 45.

Figure 4:
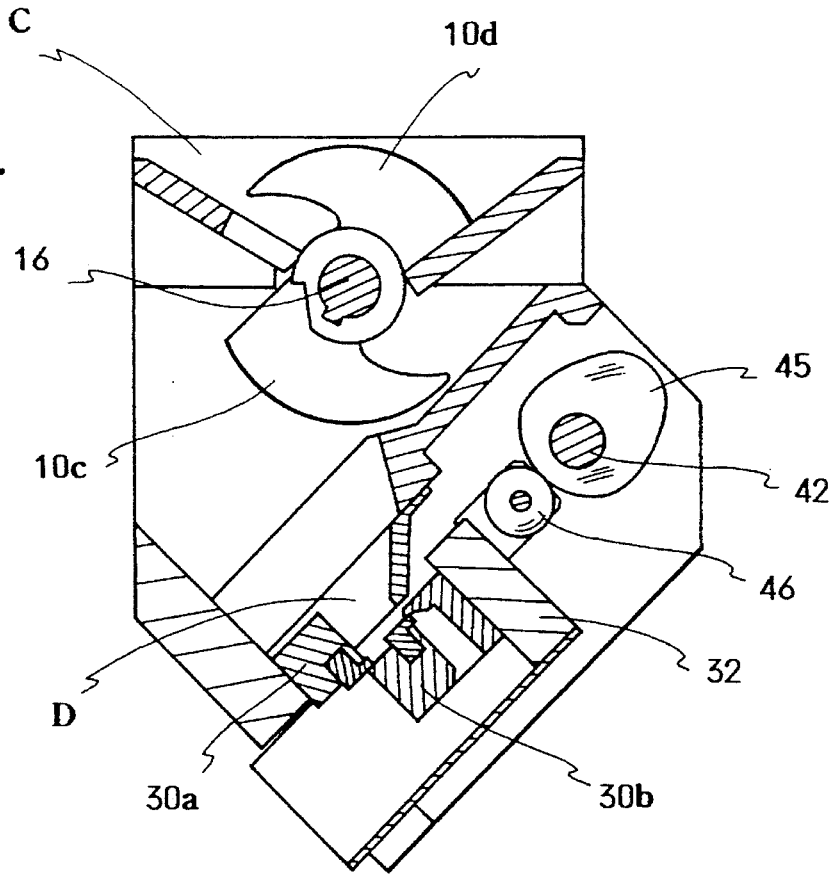
FIG. 4 is a side sectional view of a crusher of another embodiment.
Figure 5:
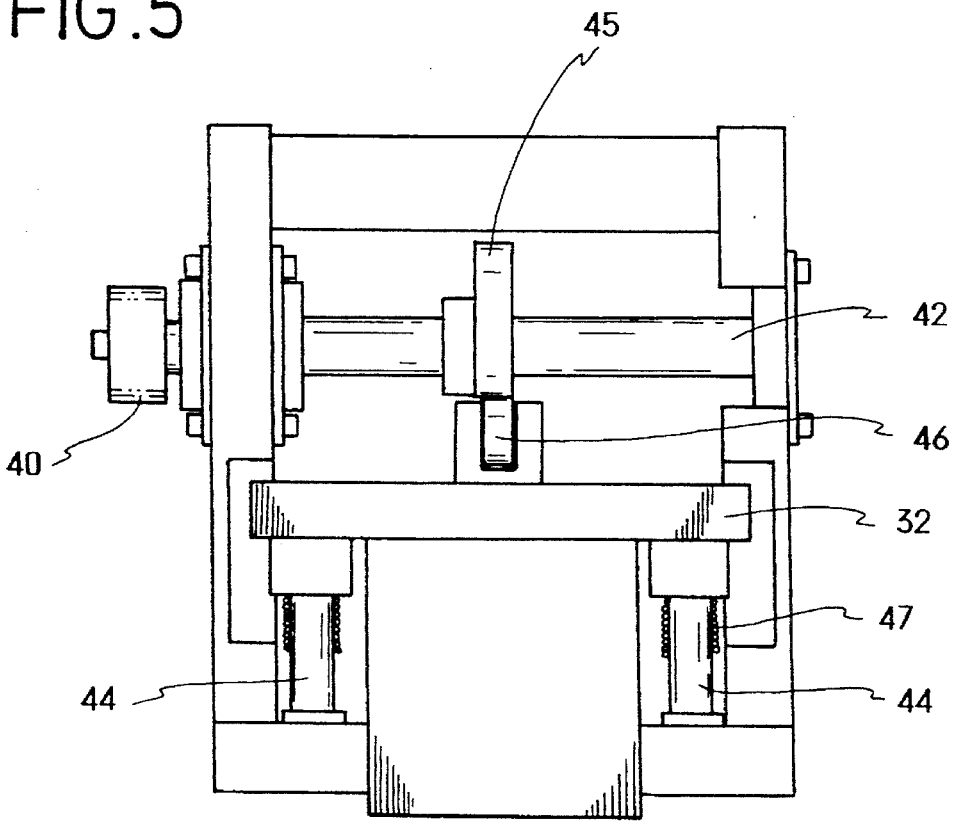
FIG. 5 is an explanation view of a driving mechanism of the embodiment shown in FIG. 4.

The cam 45 is formed into an oval shape as shown in FIG. 4, so the cam 45 is capable of cyclically pushing the roller 46 downward. By the downward force of the cam 45 and the upward elasticity of the springs 47, the roller 46 is capable of linearly and reciprocatively moving with a prescribed stroke, so that the movable member 30*b* can be reciprocatively moved.

Next, the fixed member 30*a* and the movable member 30*b* of the crushing section D will be explained.

Figure 6:
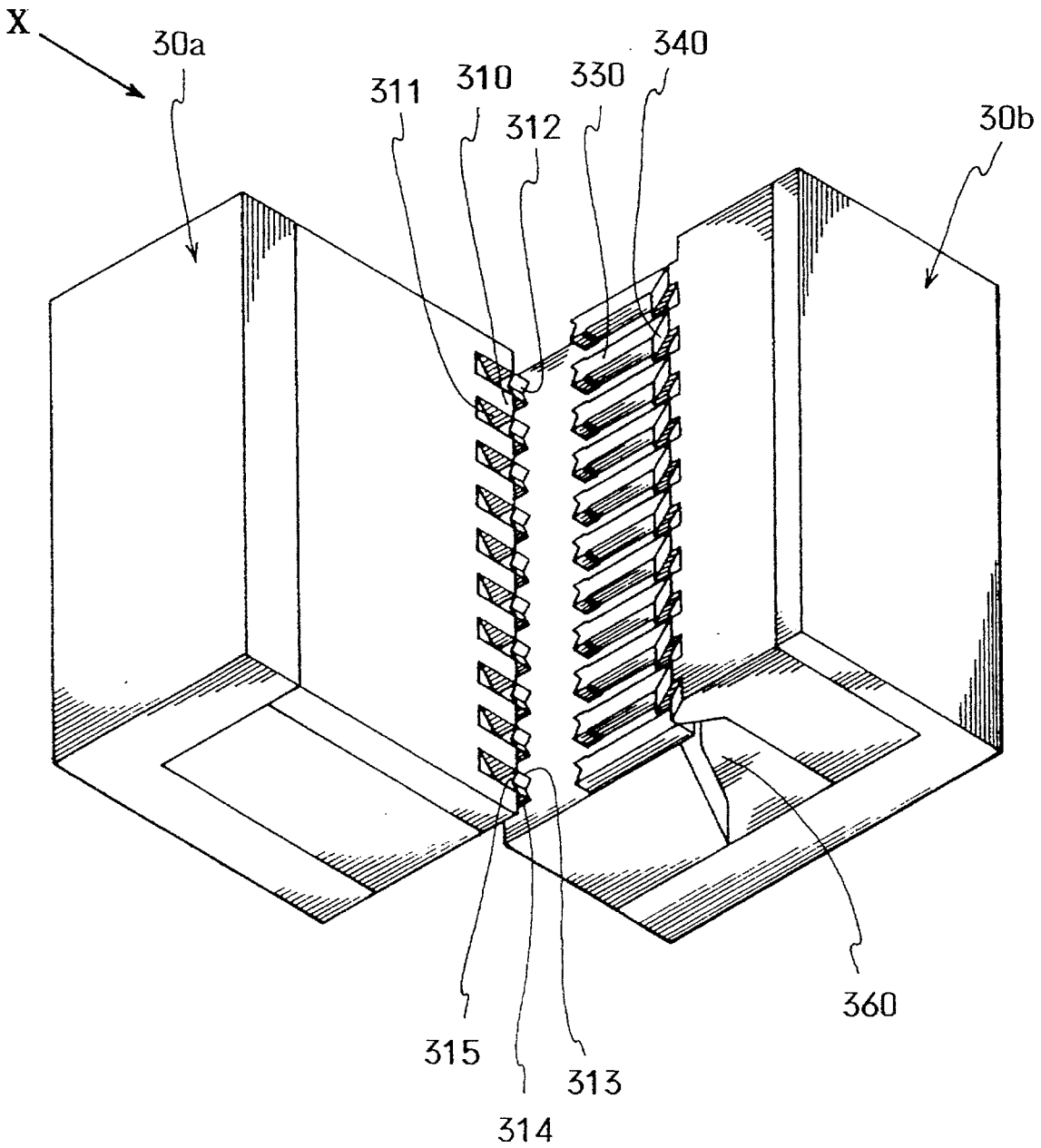
FIG. 6 is a perspective view of a fixed member and a movable member.
Figure 7:
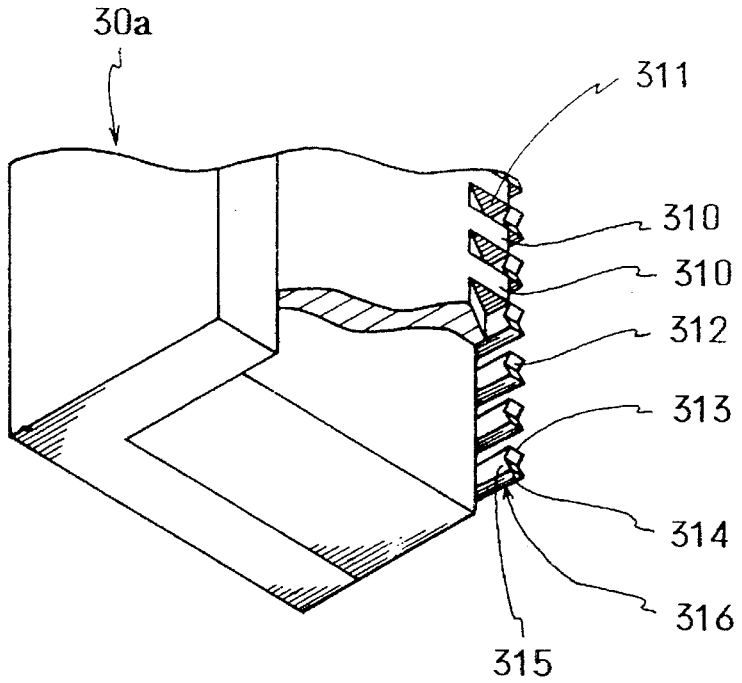
FIG. 7 is a perspective view, with portions broken away for clarity, of the fixed member.
Figure 8:
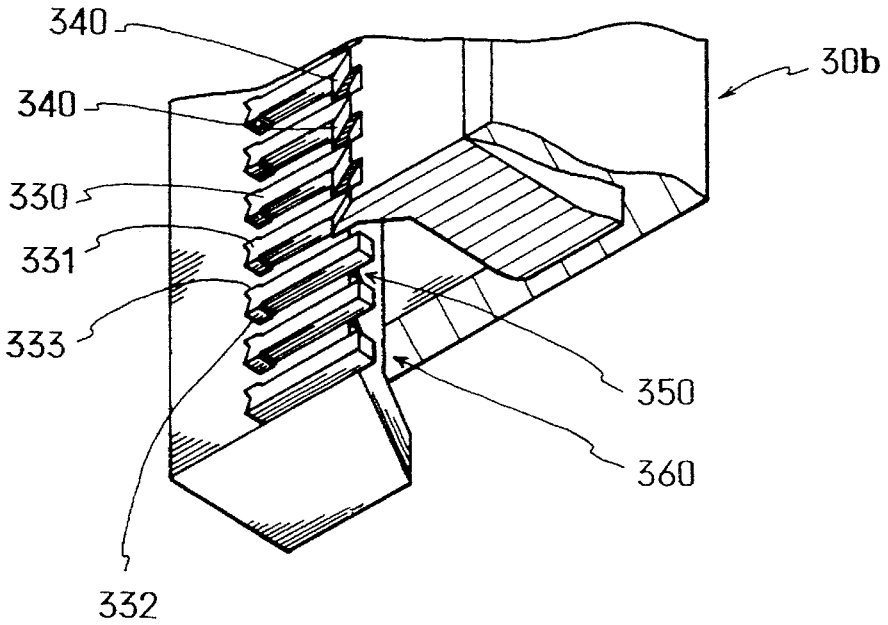
FIG. 8 is a perspective view, with portions broken away for clarity, of the movable member.
Figure 9:
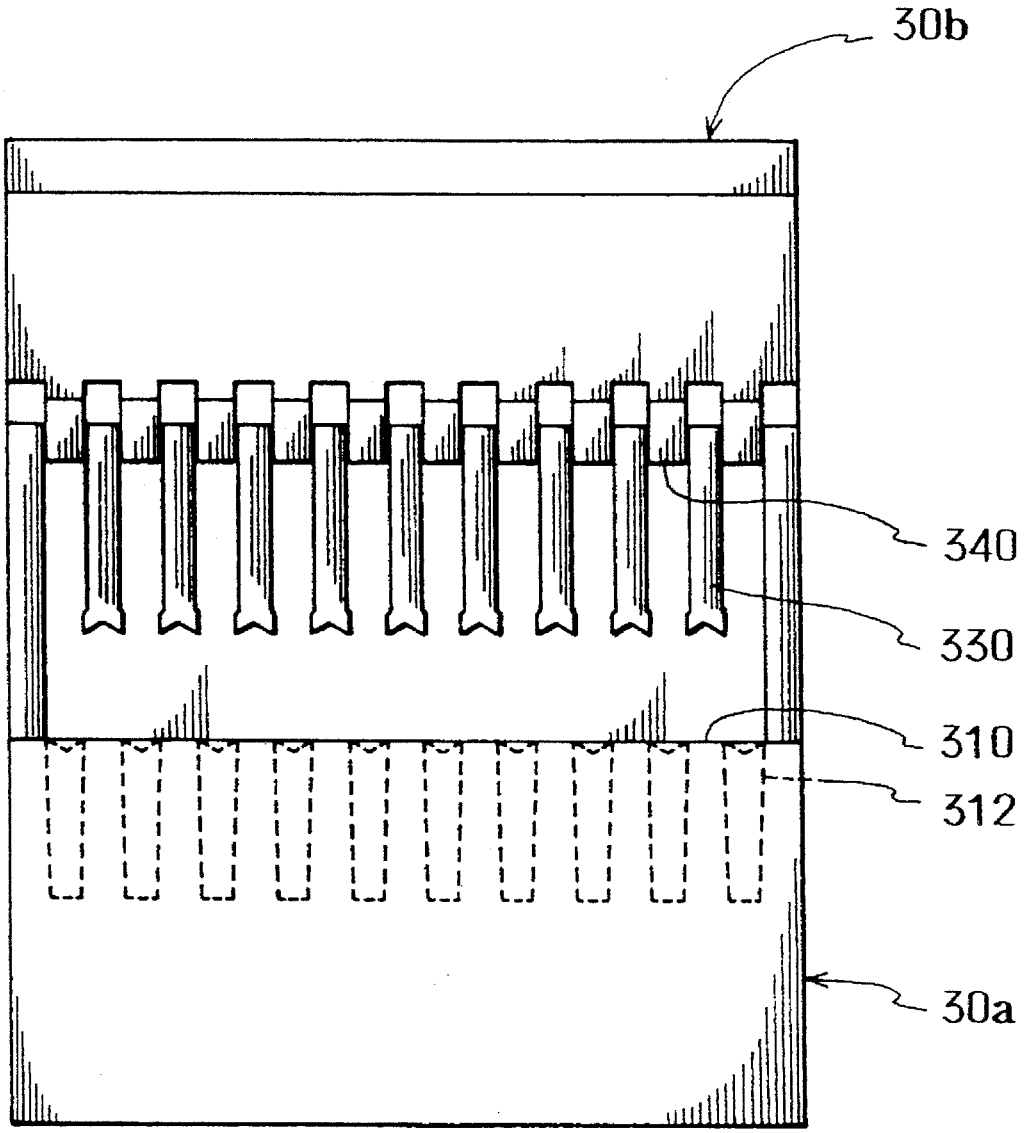
FIG. 9 is a view in the direction of an arrow X shown in FIG. 6.

FIG. 6 is a perspective view of the fixed member 30*a* and the movable member 30*b*; FIG. 7 is a perspective view, with portions broken away for clarity, of the fixed member 30*a*; FIG. 8 is a perspective view, with portions broken away for clarity, of the movable member 30*b*; and FIG. 9 is a view in the direction of an arrow X shown in FIG. 6.

In FIG. 6, a fixed member proper is formed into a block shape and has edge sections 310 in one side. There are formed inclined concave sections 311, whose depth is made deeper toward front ends, between the adjacent edge sections 310.

Projected sections 312 are projected between the adjacent edge sections 310 like comb-teeth. Namely, the projected sections 312 are projected from the front end portions of the inclined concave sections 311 in the fixed member proper toward the movable member 30*b*. As shown in FIGS. 6 and 7, the edge sections 310 and the front end portions of the inclined concave sections 311 are linearly arranged, and the projected sections 312 are projected outward from them.

Front ends of the projected sections 312 have rectangular faces. Both side faces 313 and 314 and an upper faces 315 of the projected sections 312 are shearing blade faces. A plurality of groove-blades, each of which comprises the edge section 310 and the corresponding blade faces 313 and 314, are a first shearing section 318 (see FIG. 12). Furthermore, a plurality of inclined concave sections 311 including the blade faces 315 are a second shearing section 320 (see FIG. 14). Thus, the fixed member 30*a* has a plurality of groove-blades as the first shearing section 318 at regular intervals and a plurality of the inclined concave sections 311 as the second shearing section 320 between said adjacent groove-blades. Note that, faces 316 of the projected sections 312 which face to the movable member 30*b* slidably contact the movable member 30*b*.

In FIG. 8, the movable member 30*b* has a third shearing section 330, which is provided on an upper face of a movable member proper. The third shearing section 330 has a plurality of projected blades, which are capable of slidably engaging with the groove-blades of the first shearing section 318 for shearing scraps. Each projected blades of the third shearing section 330 has shearing blade faces 332 and 333. Front ends of the projected blades have rectangular faces. The projected blades of the third shearing section 330 slidably come into the groove-blades of the first shearing section 318 when the movable member 30*b* is moved to the fixed member 30*a*.

The movable member 30*b* also has a fourth shearing section 340. The fourth shearing section 340 has a plurality of projections, each of which is arranged between the adjacent projected blades of the third shearing section 330 like comb-teeth. The projections of the fourth shearing section 340 are located rearwardly with respect to the projected blades of the third shearing section 330. The projections of the fourth shearing section 340 are capable of fitting into the inclined concave sections 311. The projections are diagonally formed thinner toward front ends.

As clearly shown in FIG. 8, the projected blades of the third shearing section 330 are provided on the movable member proper at regular intervals, so there are formed grooves between the adjacent projected blades. There are formed opening sections 350 at rear ends of said grooves. The opening sections 350 are communicated to a discharge hole 360 for discharging crushed pieces outside, which is formed downward in the movable member 30*b*.

As described above, the fixed member 30*a* has the first and the second shearing members 318 and 320; the movable member 30*b* has the third and the fourth shearing members 330 and 340. With this structure, the first and the third shearing members 318 and 330 crush the scraps, which have been preparatorily crushed by the preparatory crushing section C, as primary crush, then the second and the fourth shearing sections 320 and 340 further crush the scraps, which have been primarily crushed by the first and the third shearing members 318 and 330, as secondary crush.

To manufacture the fixed member 30*a* and the movable member 30*b*, forming materials, e.g., steel, may be selected on the basis of hardness of scraps, etc. For example, the shearing sections of the fixed member 30*a* and the movable member 30*b* may be made from cemented carbide, and rests may be made of stainless steel. In the example shown in FIGS. 6–8, the fixed member 30*a* and the movable member 30*b* are assembled with a plurality of members.

The fixed member 30*a* and the movable member 30*b* have many small blades, so it is very difficult to machine so as to form many small blades if the cemented carbide is employed as a blade material. Furthermore, manufacturing cost must be increased. To avoid these disadvantages, the blades may be separately manufactured and adhered onto the fixed member proper and the movable member proper with adhesives having higher adhering force. By adhering the blades, it is very easy to arrange the blades onto the fixed member proper and the movable member proper, so that manufacturing time and cost can be reduced.

Successively, the action of crushing scraps will be explained with reference to FIGS. 10–15.

Figure 10:
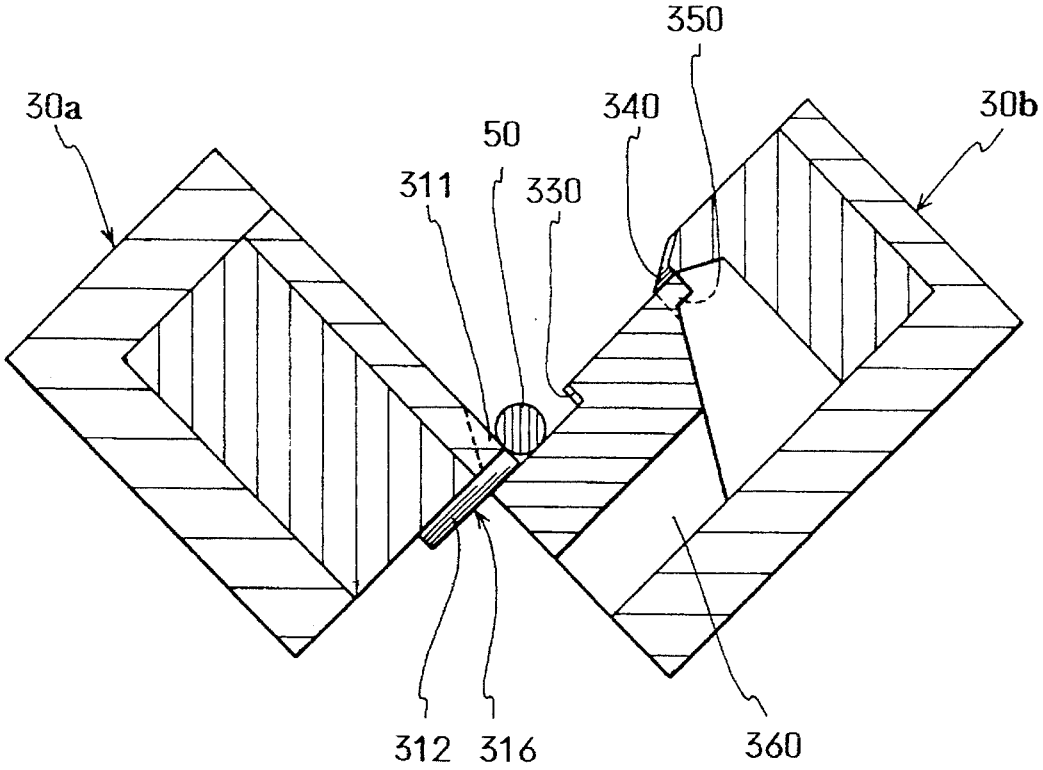
FIG. 10 is an explanation view showing positions of the fixed member and the movable member prior to crushing.
Figure 11:
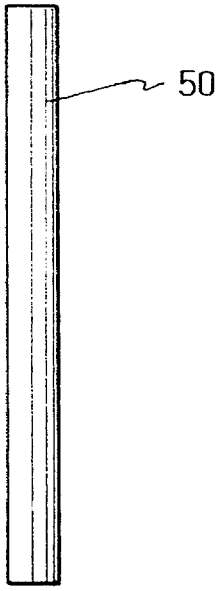
FIG. 11 is a plan view of a material to be crushed.

In FIG. 10, the fixed member 30*a* and the movable member 30*b* are in a state of before crushing a scrap 50. Namely, the movable member 30*b* is located at uppermost position. Note that, the scrap 50 is a rod-shaped resin runner (see FIG. 11).

The scrap 50 has been preparatorily crushed by the preparatory crushing section C, then it has fallen onto the engaged portion of the fixed member 30*a* and the movable member 30*b*. The faces 316 of the projected sections 312 of the fixed member 30*a* slidably contact the movable member 30*b* so as to support the scrap 50.

Figure 12:
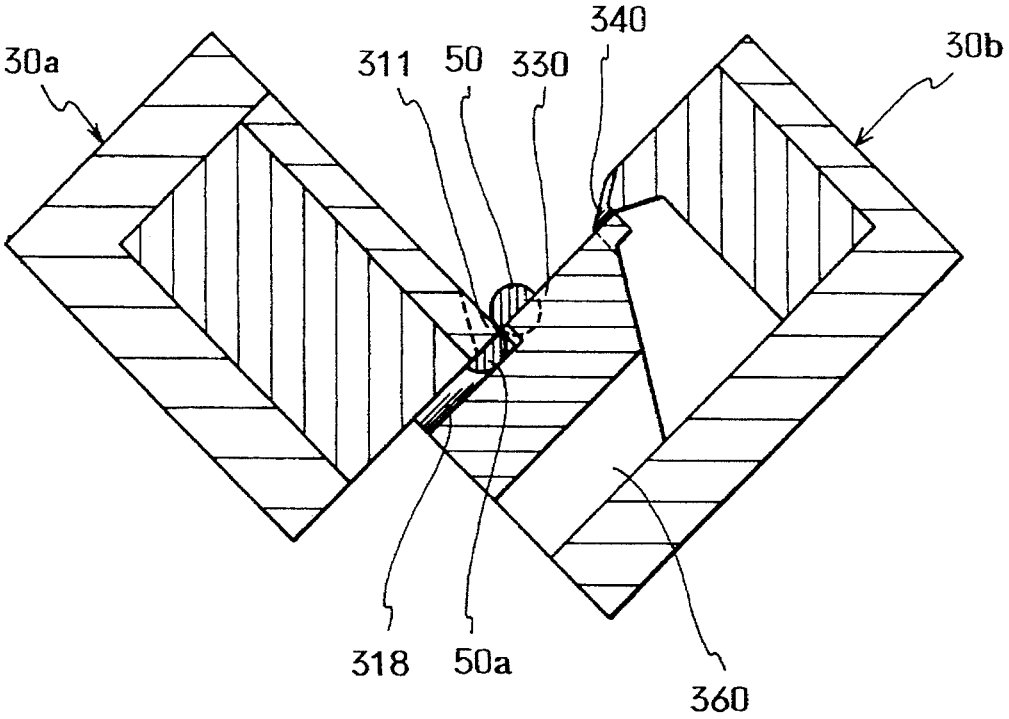
FIG. 12 is an explanation view showing a state of a primary crushing.
Figure 13:
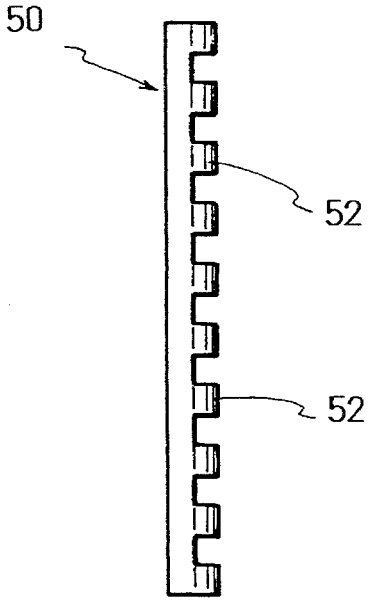
FIG. 13 is a plan view of the material, which has been primarily crushed.

In the state shown in FIG. 10, the movable member 30*b* is moved diagonally downward, then the scrap 50 is crushed between the first shearing section 318 and the third shearing section 330 (the primary crush). The state of the primary crush is shown in FIG. 12. The scrap 50 is pinched and sheared by the first shearing section 318 and the third shearing section 330, and the scrap 50 sheared has an uneven shape shown in FIG. 13. To described in detail, the scrap 50 is pinched between the projected sections 312, the third shearing section 330 and an edge portion of the fixed member proper, and faces of the projected sections 312 and the third shearing section 330, which are capable of pinching the scrap 50, have V-groove, so that the scrap 50 can be reliably pinched and held therebetween.

In FIG. 12, crushed pieces 50*a*, which are formed by the primary crush, are ejected by the third shearing section 330 with the downward movement of the movable member 30*b*. The ejected pieces 50*a* fall down from there.

Figure 14:
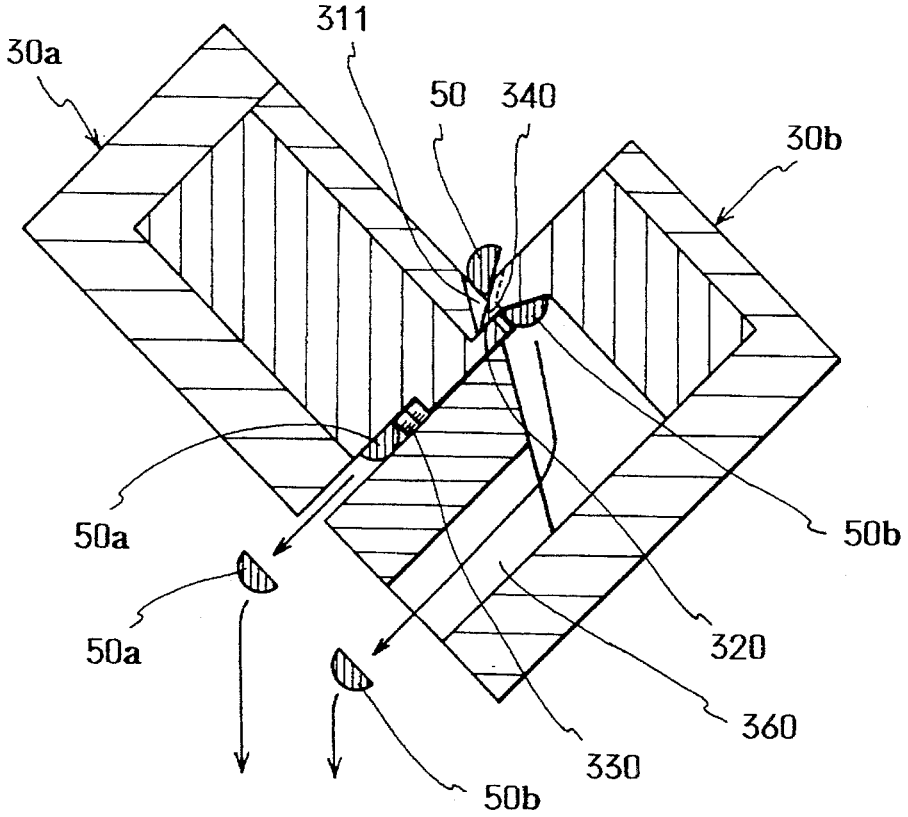
FIG. 14 is an explanation view showing a state of a secondary crushing.
Figure 15:
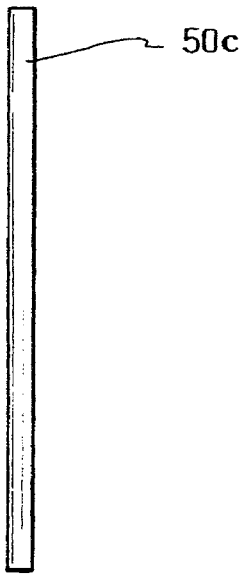
FIG. 15 is a plan view of the material, which has been secondarily crushed.
Figure 16:
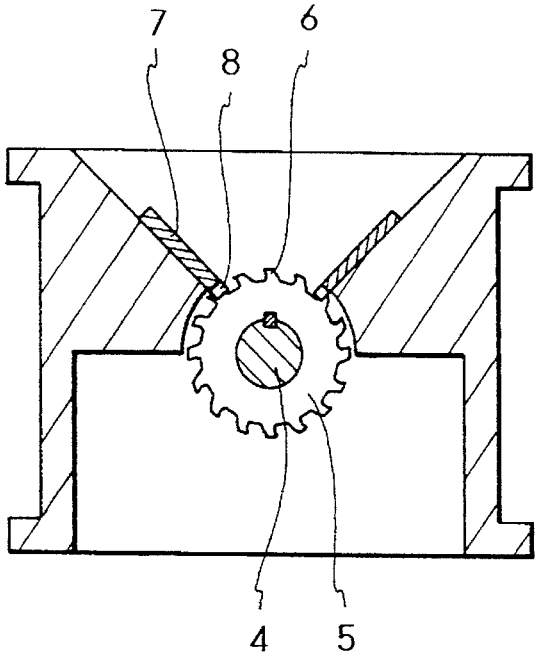
FIG. 16 PRIOR ART
FIG. 16 is a side sectional view of the conventional crusher.
Figure 17:
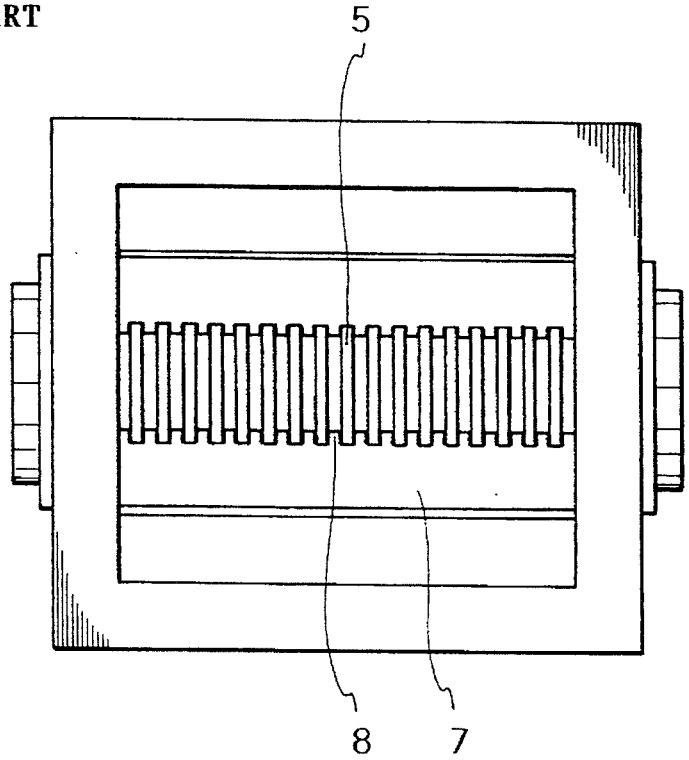
FIG. 17 PRIOR ART
FIG. 17 is a plan view of the conventional crusher.

In the state shown in FIG. 14, the movable member 30*b* has been further moved downward, and the scrap 50 is crushed between the second shearing section 320 and the fourth shearing section 340 (the secondary crush). The projections of the fourth shearing section 340 are fitted into the inclined concave sections 311 of the second shearing section 320, so that the scrap 50, which have been primarily crushed, is further crushed. By the secondary crush, projected parts 52 of the scrap 50, which has been primarily crushed, are sheared. The edge sections 310 of the first shearing section 318 and the second shearing section 320 are linearly arranged as described above, a sheared face of the scraps 50*c*, which has been secondarily crushed by the second shearing section 320 and the fourth shearing section 340, is formed flat (see FIG. 15). Namely, the scrap 50 (FIG. 11) is once formed into the uneven shape (FIG. 50) by the primary crush, then the projected parts 52 are sheared by the secondary crush, so that the scrap 50 is formed into the shape 50*c* (FIG. 15).

After the primary crush, the third shearing section 330 bites the scrap 50 while the movable member 30*b* is moved downward. And the secondary crush is executed immediately after the primary crush. Thus, the scrap 50 is securely held, so that only the projected parts 52 are sheared by the second and the fourth shearing sections 320 and 340.

The crushed pieces 50*b* (the projected parts 52), which has sheared by the secondary crush, are introduced into the the discharge hole 360 via the opening sections 330 of the third shearing section 330, and discharged outside.

Upon completing the secondary crush, the movable member 30*b* is returned to the position shown in FIG. 10 for the next crush. When the movable member 30*b* is returned to the initial position, next scrap 50 to be crushed is allowed to move to the engaged portion of the fixed and the movable members 30*a* and 30*b* for the next crush. The scrap 50*c* left (FIG. 15) will be crushed into the pieces 50*a* and 50*b* in the next crushing process.

In the present embodiment, scraps are continuously crushed into small pieces with the linear reciprocative movement of the movable member 30*b*. Parts of a scrap are crushed into small pieces by the primary crush, then the rest parts of the scrap are crushed into small pieces by the secondary crush, so that the scrap can be reliably crushed. Even if scraps have complex shapes, they can be crushed into small pieces, whose sizes are smaller than prescribed size, by repeating the primary crush and the secondary crush.

In the present embodiment, the first and the second shearing sections are provided in the fixed member and the third and the fourth shearing sections are provided in the movable member. But the first and the second shearing sections may be provided in the movable member and the third and the fourth shearing sections may be provided in the fixed member. Moreover, the both members may be movable.

Since the crusher of the present invention is capable of partially and repeatedly crushing scraps (materials), scraps having various sizes can be crushed into small pieces smaller than a prescribed size. The size of the crushed pieces can be defined by the sizes of the shearing sections. Namely, if small sized pieces are desired, the sizes of the shearing sections will be small; if large sized pieces are desired, the sizes thereof will be large. The sizes of the shearing sections can be designed on the basis of the reuse of scraps.

With the crusher of the present embodiment, plastic scrap pieces having almost uniform size can be gained. Since they can be used as resin pellets for plastic molding, the crusher is very useful for reuse of plastic scraps.

Since scraps are crushed by pinching and shearing with the fixed member and the movable member, the crusher of the present invention is able to more efficiently crush scraps than conventional crushers, which crush scraps with rotary blade members. Thus, in the present invention, the driving mechanism need not have great power.

In the present embodiment, the width of the fixed and the movable members 30*a* and 30*b* is around 80 mm, so the present invention is able to provide a compact crusher having higher crushing performance. Note that, in case of large amount of scraps, the width of the fixed and the movable members may be larger so as to increase the number of shearing points, so that mass crushing of scraps can be executed in a short time.

Since the crusher of the present invention can be compact, so it can be assembled, for example, in an injection molding machine. Resin scraps, e.g., runners, formed in the injection molding machine can be immediately crushed by the crusher assembled. In this case, resin molding and scrap crushing can be executed in one machine.

Note that, the crusher for crushing plastic (resin) scraps has been described above but the crusher of the present invention is not limited to the plastic crusher. Of course, many kinds of materials, e.g., rubber, glass, can be crushed by the crusher of the present invention.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and range of equivalency of the claims are therefore intended to be embraced therein.

What is claimed is:

1. A crusher, comprising:

a fixed member having a first blade portion for crushing a material to be crushed into pieces;

a movable member being capable of moving to and away from said fixed member, said movable member having a second blade portion, which crushes the material into pieces with said first blade portion when said movable member is moved toward said fixed member;

a driving mechanism for moving said movable member to and away from said fixed member; and a preparatory crushing section which includes a rotary blade member, wherein the material is preparatorily crushed by said preparatory crushing section and introduced to said fixed member and said movable member.

2. A crusher, comprising:

a fixed member having a first blade portion for crushing a material to be crushed into pieces;

a movable member being capable of moving to and away from said fixed member, said movable member having a second blade portion, which crushes the material into pieces with said first blade portion when said movable member is moved toward said fixed member;

a driving mechanism for moving said movable member to and away from said fixed member;

said first blade portion including:

a first shearing section for primarily shearing the material; and a second shearing section for secondarily shearing the material; which has been primarily sheared, and said second blade portion including:

a third shearing section, which primarily shears the material with said first shearing section when said movable member is moved toward said fixed member; and a fourth shearing section, which secondarily shears the material with said second shearing section when said movable member is further moved toward said fixed member and as said third shearing section is moved away from said first shearing section.

3. The crusher according to claim 2 wherein, a fixed member proper and a movable member proper are formed into block shapes, said first shearing section comprises a plurality of groove-blades, which are formed with parts of an edge of said fixed member proper and side sections of a plurality of projected sections, which are projected from the edge thereof, said second shearing section comprises a plurality of concave sections, which are formed in fixed end portions of the projected sections, said third shearing section comprises a plurality of projected blades, which are arranged in said movable member proper so as to engage with the groove-blades of said first shearing section, and said fourth shearing section comprises a plurality of projections, which are arranged in said movable member proper so as to fit into the concave sections of said second shearing section.

4. The crusher according to claim 3, wherein the side sections of the projected sections are perpendicular to the edge of said fixed member proper.

5. The crusher according to claim 3 wherein, the concave sections of said second shearing section are formed in said fixed member proper, and each concave section has an inclined inner bottom face, which is formed deeper toward the edge of said fixed member proper.

6. The crusher according to claim 3 wherein, said movable member has a discharge hole through which the pieces crushed are discharged outside, and said third shearing section has an opening section, which is connected to the discharge hole.

7. A crushing mechanism, comprising:

a first member;

a second member capable of moving to and away from said first member;

a first shearing section having a plurality of groove-blades, which are formed with parts of an edge of said first member and side sections of a plurality of projected sections, which are projected from the edge thereof;

a second shearing section having a plurality of concave sections, which are formed in fixed end portions of the projected sections;

a third shearing section having a plurality of projected blades, which are arranged in said second member so as to engage with the groove-blades of said first shearing section; and a fourth shearing section having a plurality of projections, which are arranged in said second member so as to fit into the concave sections of said second shearing section.

8. The crushing mechanism according to claim 2, wherein the side sections of the projected sections are perpendicular to the edge of said first member.

9. The crushing mechanism according to claim 2 wherein, the concave sections of said second shearing section are formed in said first member, and each concave section has an inclined inner bottom face, which is formed deeper toward the edge of said first member.

10. The crushing mechanism according to claim 2, wherein the projections of said fourth shearing section are formed thicker toward front ends.

11. The crushing mechanism according to claim 2 wherein, said second member has a discharge hole through which the pieces crushed are discharged outside, and said third shearing section has an opening section, which is connected to the discharge hole.

* * * * *